US010236146B2

(12) United States Patent
Vigouroux et al.

(10) Patent No.: US 10,236,146 B2
(45) Date of Patent: Mar. 19, 2019

(54) ELECTRIC ARC-BLAST NOZZLE AND A CIRCUIT BREAKER INCLUDING SUCH A NOZZLE

(71) Applicant: General Electric Technology GmbH, Baden (CH)

(72) Inventors: Daniel Vigouroux, Lyons (FR); Thomas Berteloot, Lyons (FR)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 0 days.

(21) Appl. No.: 15/872,409

(22) Filed: Jan. 16, 2018

(65) Prior Publication Data

US 2018/0204694 A1 Jul. 19, 2018

(30) Foreign Application Priority Data

Jan. 17, 2017 (EP) ..... 17290004

(51) Int. Cl.

| | |
|---|---|
| ***H01H 33/90*** | (2006.01) |
| ***H01H 33/70*** | (2006.01) |
| ***H01H 33/14*** | (2006.01) |
| ***H01H 33/12*** | (2006.01) |
| ***H01H 33/91*** | (2006.01) |
| ***H01B 3/00*** | (2006.01) |
| ***H01H 33/22*** | (2006.01) |

(52) U.S. Cl.
CPC ..... *H01H 33/901* (2013.01); *H01B 3/00* (2013.01); *H01H 33/12* (2013.01);
(Continued)

(58) Field of Classification Search
CPC .. H01H 33/901; H01H 33/22; H01H 33/7076; H01H 33/91; H01H 33/12;
(Continued)

(56) References Cited

U.S. PATENT DOCUMENTS 4,224,490 A * 9/1980 Frind ..... H01H 33/7023 218/54
4,562,322 A * 12/1985 Yamaguchi ..... H01H 33/021 174/110 N
(Continued)

FOREIGN PATENT DOCUMENTS

EP 0 840 341 A2 5/1998
EP 2 779 195 A1 9/2014
(Continued)

OTHER PUBLICATIONS

Extended European Search Report and Opinion issued in connection with corresponding EP Application No. 17290004.5 dated Jul. 12, 2017.

*Primary Examiner* — Truc T Nguyen
(74) *Attorney, Agent, or Firm* — GE Global Patent Operation; Scott R. Stanley

(57) ABSTRACT

The invention relates to an electric arc-blast nozzle for a circuit breaker comprising a middle portion forming a throat defining internally an axial passage for interrupting an electric arc, and two end portions extending on either side of the middle portion and being designed to receive respective arcing contacts and that are movable axially relative to each other.
The middle portion and the two end portions are made of a same dielectric material obtained from a composition consisting of a fluorocarbon polymer matrix and of at least one oxide, the oxide(s) being present in a proportion by weight lying in the range 11% to 50%, relative to the total weight of the composition.
The invention also relates to a circuit breaker including such a nozzle.

12 Claims, 1 Drawing Sheet

(52) U.S. Cl.
CPC ..... *H01H 33/143* (2013.01); *H01H 33/22* (2013.01); *H01H 33/7023* (2013.01); *H01H 33/7069* (2013.01); *H01H 33/7076* (2013.01); *H01H 33/91* (2013.01)

(58) Field of Classification Search
CPC ..... H01H 33/143; H01H 33/7023; H01H 33/7069; H01B 3/00
See application file for complete search history.

(56) References Cited

U.S. PATENT DOCUMENTS

| | | | | |
|---|---|---|---|---|
| 5,925,863 | A * | 7/1999 | Zehnder | H01H 33/7023 218/53 |
| 2007/0221626 | A1* | 9/2007 | Uchii | H01H 33/56 218/57 |
| 2009/0294406 | A1 | 12/2009 | Bessede et al. | |
| 2014/0291292 | A1* | 10/2014 | Pisu | H01H 33/22 218/52 |
| 2015/0021297 | A1* | 1/2015 | Stoller | H01H 33/7023 218/51 |
| 2016/0241004 | A1* | 8/2016 | Kieffel | H01B 3/56 |
| 2016/0307716 | A1* | 10/2016 | Florez | H01H 33/22 |
| 2018/0240626 | A1* | 8/2018 | Kosse | H01H 33/22 |

FOREIGN PATENT DOCUMENTS

| | | | |
|---|---|---|---|
| FR | 2 960 338 | A1 | 11/2011 |
| WO | 2009/080123 | A1 | 7/2009 |

* cited by examiner

ELECTRIC ARC-BLAST NOZZLE AND A CIRCUIT BREAKER INCLUDING SUCH A NOZZLE

BACKGROUND OF THE INVENTION

The present invention relates to a nozzle for blowing out an electric arc, this nozzle being designed to be incorporated either in a medium-voltage circuit breaker, the voltage of which typically lying in the range 7.2 kV to 52 kV, or in a high-voltage circuit breaker, the voltage of which typically lying in the range 52 kV to 800 kV.

The invention also relates to a high-voltage circuit breaker fitted with such an electric arc-blast nozzle.

An arc-blast circuit breaker comprises at least two arcing contacts that are movable axially relative to each other, between an open position of the circuit breaker in which the arcing contacts are separated from each other and a closed position of the circuit breaker in which the arcing contacts are in contact with each other; an electric arc-blast nozzle; and an arc-control gas flowing in the nozzle in order to interrupt an electric arc that is likely to form during movement of the arcing contacts from the closed position to the open position of the circuit breaker.

A conventional electric arc-blast nozzle comprises the following portions:

a middle portion forming a throat defining internally an axial passage for breaking an electric arc, and two end portions extending on either side of the middle portion and being designed to receive respective arcing contacts that are movable axially relative to each other, between an open position of the circuit breaker in which the arcing contacts are separated from each other and a closed position of the circuit breaker in which the arcing contacts are in contact with each other and in which one of the arcing contacts partially closes the axial passage of the middle portion, an arc-control gas flowing through the axial passage of the middle portion in order to interrupt an electric arc that is likely to form during movement of the arcing contacts from the closed position to the open position of the circuit breaker.

In order to interrupt an electric arc, an arc-blast circuit breaker uses an arc-control gas formed by an insulating dielectric gas. This arc-control gas is delivered from a blast chamber into the axial passage of the middle portion of an above-described electric arc-blast nozzle. Such a nozzle has the function of channeling the electric arc and, by doing so, of increasing the pressure of the arc-control gas in the vicinity of the electric arc, thus promoting arc extinction.

Currently, the most frequently-used arc-control gas for that type of circuit breakers is sulfur hexafluoride $SF_6$ because of the exceptional physical properties of said gas. However, $SF_6$ presents the major drawback of being a very powerful greenhouse gas, with a particularly high global warming potential (GWP).

Among the alternatives to the use of $SF_6$ as an arc-control gas, various gases of global warming potential (GWP) that is lower than that of $SF_6$ are known, such as dry air or also nitrogen.

A particularly advantageous arc-control gas is carbon dioxide $CO_2$ because of its strong electric insulation and arc-extinction capabilities. Furthermore, $CO_2$ is non-toxic, non-flammable, with a very low GWP, and is also easy to procure.

$CO_2$ can be used alone or in the form of a gas mixture, of which it constitutes the main gas referred to as "vector gas".

But, and contrary to the $SF_6$ which has the property of recombining after decomposition by arc discharge, $CO_2$ cannot recombine and namely produces a significant amount of gaseous toxic carbon monoxide CO and of carbon powder.

In order to remove such a toxic CO gas, several solutions have been proposed.

A first solution consists in providing the arc-blast circuit breaker with a synthetic zeolite as a CO adsorptive agent.

The drawback of that first solution lies in the fact that such a zeolite cannot sufficiently remove CO as the zeolite also adsorbs the insulating $CO_2$ gas.

As a second solution, document EP 2 779 195, referenced [1] hereinafter in the present description, discloses an electric arc-blast nozzle provided with a metal oxide at a portion contacting with a heat stream generated by an arc discharge that is likely to form during movement of the arcing contacts from the closed position to the open position of the arc-blast circuit breaker. The metal oxide disposition method may include a method of forming the contacting portion with a metal oxide, a method of coating the contacting portion with a cover material of a metal oxide or a method of coating the contacting portion with a metal oxide film.

According to Document [1], the contacting portion should reach a temperature of at least 200° C. for obtaining the recombination of CO gas into $CO_2$ gas. Indeed, in such temperature conditions, the metal oxide located in the contacting portion acts as an oxidizer. An example of the corresponding reaction, with $MnO_2$ as metal oxide, follows:

$$2C\,O' + MnO_2 \rightarrow 2C\,O_2' + Mn$$

For obtaining such a reaction, the contacting portion with the metal oxide is placed in an area that is very close to the electric arc in order to reach the required temperature of at least 200° C. However, this contacting portion, which is in contact with the gas stream and subjected to a temperature of at least 200° C., is a very confined area. The corresponding metal oxide content is consequently relatively limited and, in most cases, not sufficient to convert CO gas into $CO_2$ gas.

In addition, circuit breakers are today designed to interrupt an electric arc in a few milliseconds (ms), typically between 5 ms and 25 ms. But, heat transfer by means of conduction cannot occur within such a time range and only heat transfer by convection and by radiation contributes to a temperature rise of the contacting portion. The corresponding heat flow thus remains superficial and does not allow a good conversion of CO gas into $CO_2$ gas.

Additionally, it must be noted that Document [1] is totally silent on the carbon powder deposit, such a deposit impairing the dielectric strength of the electric arc-blast nozzle.

The invention therefore aims to propose a novel electric arc-blast nozzle that enables the drawbacks of prior art electric arc-blast nozzles to be mitigated.

In particular, this new nozzle must be suitable for fitting to a circuit-breaker operating with $CO_2$ alone or with a gas mixture including $CO_2$ as vector gas, such a circuit-breaker being provided with a conversion of CO gas into insulating $CO_2$ gas that is higher than the one of the electric arc-blast nozzle disclosed by Document [1].

The new nozzle must also be suitable for fitting to such a circuit breaker without any increase in its bulk and without any noticeable increase in costs, namely in terms of manufacturing process, as it is the case for the electric arc-blast nozzle disclosed by Document [1].

SUMMARY OF THE INVENTION

The above-mentioned aims as well as others are achieved, firstly, by an electric arc-blast nozzle for a circuit breaker of the above-mentioned type, i.e. by a nozzle comprising:

a middle portion forming a throat defining internally an axial passage for breaking an electric arc, and two end portions extending on either side of the middle portion and being designed to receive respective arcing contacts that are movable axially relative to each other, between an open position of the circuit breaker in which the arcing contacts are separated from each other and a closed position of the circuit breaker in which the arcing contacts are in contact with each other and in which one of the arcing contacts partially closes the axial passage of the middle portion, an arc-control gas flowing through the axial passage of the middle portion in order to interrupt an electric arc that is likely to form during movement of the arcing contacts from the closed position to the open position of the circuit breaker.

According to the invention, the middle portion together with the two end portions of the nozzle are made of a same dielectric material, such a dielectric material being obtained from a composition consisting of a fluorocarbon polymer matrix and of at least one oxide, the oxide(s) being present in a proportion by weight lying in the range 11% to 50%, relative to the total weight of the composition.

The choice of the particular composition, which consists of a fluorocarbon polymer matrix and of at least one oxide as a filler, for the dielectric material of the middle portion and the two end portions of the nozzle makes it possible to improve the conversion of CO gas and of carbon powder into insulating $CO_2$ gas, while imparting good mechanical properties and good high-temperature behavior to the electric arc-blast nozzle.

More particularly, the at least one oxide, which acts as an oxidizer in the corresponding chemical reaction, is progressively released into the environment surrounding the electric arc under the ablation of the dielectric material caused by the intense radiation from this electric arc. Such an oxide release allows a continuous conversion of CO gas and of carbon powder into insulating $CO_2$ gas.

As already mentioned, the dielectric material that forms the middle portion and the two end portions of the electric arc-blast nozzle is obtained from a particular composition consisting of a fluorocarbon polymer matrix and of at least one oxide in a proportion by weight lying in the range 11% to 50%, relative to the total weight of the composition.

It is possible to envisage manufacturing, as one single part, the assembly formed by the middle portion and the two end portions.

In a first variant of the invention, the at least one oxide is a metal oxide.

Such a metal oxide may namely be selected from the metal oxides disclosed by Document [1], namely the metal oxides listed in paragraph [0024] of this prior art document.

In an advantageous embodiment of this first variant, the metal oxide is selected from $TiO_2$, $Al_2O_3$, $Al_2CoO_4$, $Nb_2O_3$ and $BaTiO_3$. These metal oxides, which are not disclosed by Document [1] but are conventionally used for the polytetrafluoroethylene (PTFE) nozzle of $SF_6$ circuit breakers, allow to improve the thermal cut-off effect and the mechanical strength of the electric arc-blast nozzle according to the invention.

In a more particularly preferred embodiment, the metal oxide is selected from $Al_2O_3$ and $Al_2CoO_4$.

In a second variant of the invention, the at least one oxide is a non-metal oxide.

In an advantageous embodiment of this second variant, the non-metal oxide is selected from $SiO_2$, $P_2O_5$ and $Bi_2O_3$, being noted that these non-metal oxides are also not disclosed by Document [1].

In a more particularly preferred embodiment, the non-metal oxide is $SiO_2$, which provides the nozzle with particular excellent resistance to radiation from the electric arc. Moreover, $SiO_2$, which is lighter than the other metal oxides or non-metal oxides, is also cheap and widely commercially available.

$Al_2O_3$, $Al_2CoO_4$ and $SiO_2$ are actually preferred since these oxides provide the nozzle with optimal resistance to the intense radiation of the electric arc, increasing the electrical endurance of a circuit breaker provided with such a nozzle.

The conversion of CO into $CO_2$ replies to the following reactions, depending on the oxide implemented:

$$2C\,O^{\nearrow} + SiO_2 \rightarrow 2C\,O_2^{\nearrow} + Si$$

$$3C\,O^{\nearrow} + Al_2O_3 \rightarrow 3C\,O_2^{\nearrow} + 2Al$$

$$4C\,O^{\nearrow} + Al_2CoO_4 \rightarrow 4C\,O_2^{\nearrow} + 2Al + Co$$

As already mentioned, the proportion by weight of the at least one oxide lies in the range 11% to 50% relative to the total weight of the composition.

This proportion by weight may be determined by an estimation of the quantity of oxygen that should be implemented for the conversion of CO gas into $CO_2$ gas, in view of the above reactions.

Table 1 below shows the corresponding minimum proportions of weight as calculated for each of the oxides implemented in the above three reactions.

TABLE 1

| Oxide | $SiO_2$ | $Al_2O_3$ | $Al_2CoO_4$ |
|---|---|---|---|
| Molar weight (g/mol) | 60.1 | 102.0 | 176.9 |
| Minimal oxide content (mol) | 0.12 | 0.08 | 0.06 |
| Corresponding mass (g) | 7.3 | 8.3 | 10.8 |
| Minimum proportion of weight (%) | 14 | 16 | 20 |

The minimal oxide content corresponds to an estimation of the molar content of CO present in a circuit breaker after breaking tests, such an estimation being equivalent to 1% of the total amount of gas contained in the circuit breaker.

In an advantageous variant of the invention, the proportion by weight of the at least one oxide lies in the range 12% to 25% relative to the total weight of the composition.

Such an advantageous range of proportions by weight of oxide(s) provides a good CO into $CO_2$ conversion without degrading the mechanical strength of the electric arc-blast nozzle.

The at least one oxide of the composition may consist in only one single oxide, i.e. only one metal oxide or only one non-metal oxide.

But, the at least one oxide of the particular composition may also consist in an alloy consisting in a mixture of two, three, or more, metal oxides and/or non-metal oxides.

Such a mixture may include only metal oxides, only non-metal oxides, or one or more metal oxides and one or more non-metal oxides.

An example of such a latter alloy is $Bi_2O_3$—ZnO—$Nb_2O_3$.

The dielectric material that forms the middle portion and the two end portions of the electric arc-blast nozzle is obtained from a composition consisting of a fluorocarbon polymer matrix and of at least one oxide.

In the context of the present invention, the term "matrix" means that the fluorocarbon polymer constitutes the compound having a proportion by weight, in the composition under consideration that is in the majority. This proportion by weight is at least 50% and, in an embodiment, at least 75%.

The fluorocarbon polymer of this composition may be selected from a polytetrafluoroethylene (PTFE), a vinylidene polyfluoride (PVDF) and a copolymer of ethylene and of tetrafluoroethylene (ETFE).

In an embodiment, this fluorocarbon polymer is a polytetrafluoroethylene (PTFE).

In an advantageous embodiment, the nozzle of the invention may further comprise a sheath disposed on the outside surface of each of the two end portions and on the outside surface of the middle portion forming a throat.

Such a sheath may in particular make it possible to provide the connection between the movable portions of a circuit breaker fitted with a nozzle of the invention.

By way of example, such a sheath may be put into place by machining, by molding, or also by overmolding on the end portions and on the middle portion that form the nozzle.

This sheath is made out of a second dielectric material also presenting good mechanical properties and good high-temperature behavior.

The second dielectric material of the sheath may be obtained from a second composition comprising a polymer matrix.

This second composition may comprise a fluorocarbon polymer such as a polytetrafluoroethylene (PTFE), a vinylidene polyfluoride (PVDF) or a copolymer of ethylene and of tetrafluoroethylene (ETFE).

This second composition may also comprise another polymer, e.g. a polyetheretherketone (PEEK), a polysulfone (PSU), a polyphenylsulfone (PPSU), a polyimide (PI) or a polyetherimide (PEI).

This second composition may also include one or more inorganic fillers.

When they are present, the inorganic filler(s) conventionally represent a proportion by weight that can be up to 10% of the total weight of the second composition, this proportion by weight more generally lying in the range 0.01% to 5% relative to the total weight of the second composition.

Such fillers may be the oxides already mentioned for the particular composition used to prepare the dielectric material of the middle portion and the two end portions of the nozzle according to the invention. But other fillers may also be suitable for the second composition used to prepare the second dielectric material constituting such a sheath. These fillers may namely be selected from a fluoride such as $CaF_2$, a sulfide such as $MoS_2$, $Sb_2S_5$, or $Sb_2S_3$, a graphite, a mica, a glass, and a ceramic such as boron nitride BN.

In an embodiment, the thickness of the sheath may represent up to 150% of the radius of the nozzle as measured at the middle portion. This sheath thickness lies in the range 50% to 100% and, in an embodiment, in the range 70% to 80% of the radius of the nozzle as measured at the middle portion.

In an advantageous embodiment, both of the arcing contacts of the nozzle of the invention may be movable, which is not the case for the electric arc-blast nozzle disclosed by Document [1].

In another advantageous embodiment, the nozzle of the invention may further comprise a cap that surrounds the arcing contact located in the upstream end portion relative to the flow direction of the arc-control gas.

This cap is in an embodiment made of the same dielectric material than the dielectric material that forms the middle portion and the two end portions of the electric arc-blast nozzle of the invention.

The invention provides, secondly, a medium- or high-voltage circuit breaker of the type comprising:

at least two arcing contacts that are movable axially relative to each other, between an open position of the circuit breaker in which the arcing contacts are separated from each other and a closed position of the circuit breaker in which the arcing contacts are in contact with each other;

an electric arc-blast nozzle; and an arc-control gas flowing through the axial passage of the middle portion of the nozzle in order to interrupt an electric arc that is likely to form during movement of the arcing contacts from the closed position to the open position of the circuit breaker.

According to the invention, the nozzle for blowing out an electric arc of such a circuit breaker is as defined above, i.e. the middle portion together with the two end portions of this nozzle are made of a same dielectric material, such a dielectric material being obtained from a composition consisting of a fluorocarbon polymer matrix and of at least one oxide, the oxide(s) being present in a proportion by weight lying in the range 11% to 50%, relative to the total weight of the composition.

The above-described advantageous characteristics for the arc-blast nozzle as part of the circuit breaker of the invention may naturally be taken alone or in combination.

The choice of the particular dielectric material for the middle portion and the two end portions of the arc-blast nozzle makes it possible to obtain a noticeable improvement in the electrical endurance of the circuit breaker of the invention, especially when the arc-control gas implemented in the circuit breaker of in an embodiment constituted by carbon dioxide $CO_2$ or is a gas mixture comprising mainly $CO_2$.

In particular, this gas mixture may be constituted by the arc-control gas sold by Alstom under the name $g^3$ (or "green gas for grid").

Other advantages and characteristics of the invention appear on reading the detailed description below, which relates to an arc-blast nozzle structure according to the invention.

This detailed description, which in particular makes reference to accompanying FIGS. 1 and 2, is given by way of illustration and in no way constitutes a limitation on the subject-matter of the invention.

BRIEF DESCRIPTION OF THE DRAWINGS

It is stated that the elements shared in FIGS. 1 and 2 are identified by the same reference numbers.

DETAILED DESCRIPTION

Figure 1:
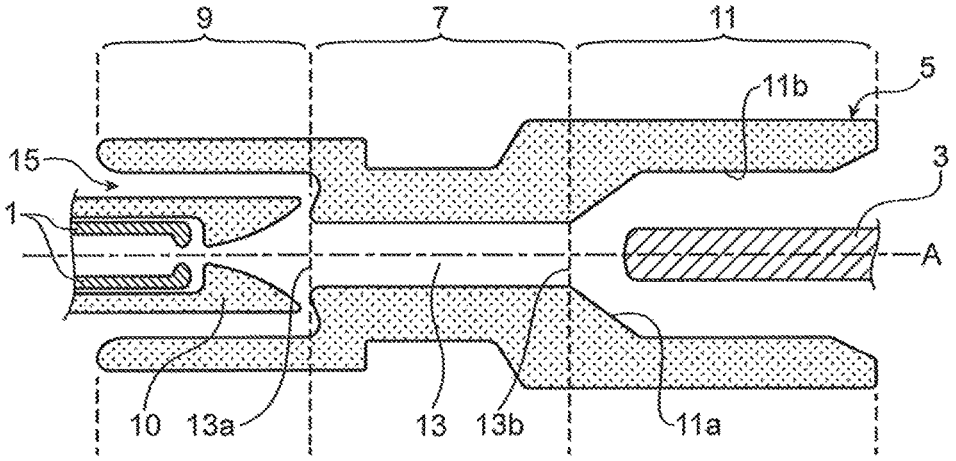
FIG. 1 is a fragmentary and diagrammatic view in longitudinal section of a circuit breaker including an electric arc-blast nozzle of the invention.

FIG. 1 shows a circuit breaker portion. The circuit breaker includes:

at least two arcing contacts 1 and 3 that are movable axially relative to each other, along an axis A, between an open position of the circuit breaker in which the arcing contacts 1 and 3 are separated from each other and a closed position of the circuit breaker in which the arcing contacts 1 and 3 are in contact with each other; and an arc-blast nozzle 5 according to the invention.

This nozzle 5 includes a throat-forming middle portion 7, an end portion 9 disposed upstream and an end portion 11 disposed downstream, the upstream and downstream disposition of the end portions 9 and 11 being relative to the flow direction of the arc-control gas. These two end portions 9 and 11 extend on either side of the middle portion 7. These portions 7, 9 and 11 are circularly symmetrical about the axis A.

The middle portion 7 defines internally an axial arc-control passage 13, said axial passage 13 having an inlet 13*a* and an outlet 13*b*. This middle portion 7 is referred to as the throat-forming middle portion 7, because of the inside sectional area of the axial passage 13, which is smaller than the inside sectional areas of each of the end portions 9 and 11.

The end portions 9 and 11 receive and surround the arcing contacts 1 and 3 respectively.

The end portion 9 disposed upstream makes it possible to channel the arc-control gas situated upstream and intended for blasting the electric arc, whereas the end portion 11 disposed downstream has the function of evacuating and diffusing the gas that has been blasted and that is situated downstream, where upstream and downstream being defined relative to the flow direction of the arc-control gas.

The end portion 9 may also comprise a cap 10 that surrounds the arcing contact 1.

In FIG. 1, the arcing contacts 1 and 3 are separated from each other and therefore correspond to the open position of the circuit breaker.

When the arcing contacts 1 and 3 are in contact with each other, in the closed position of the circuit breaker, the arcing contact 3 partially closes the axial passage 13 of the middle portion 7.

Between the arcing contact 1 and the wall of the end portion 9 there is disposed a delivery channel 15 for conveying the arc-control gas, enabling the gas to flow in the axial passage 13 of the middle portion 7, from its inlet 13*a* until it reaches its outlet 13*b*, in order to extinguish an electric arc likely to form during movement of the arcing contacts 1 and 3 from the closed position to the open position of the circuit breaker.

The end portion 11 includes a frustoconical portion 11*a* extending the middle portion 7 and situated facing the outlet 13*b* of the axial passage 13, this frustoconical portion 11*a* being followed by a cylindrical portion 11*b*.

The throat-forming middle portion 7 together with the cap 10 and the end portions 9 and 11 are made of the same dielectric material. Such a dielectric material is obtained from a particular composition, which consists of a fluorocarbon polymer matrix and of at least one oxide, the oxide(s) being present in a proportion by weight lying in the range 11% to 50%, relative to the total weight of this composition.

In addition to providing the electric arc-blast nozzle with good mechanical properties and good high-temperature behavior, this dielectric material allows a good conversion of CO gas into $CO_2$ gas and, consequently, excellent arc-control performance, which performance being long lasting.

Reference may be made to the summary of the invention for further details about the different variants of this particular composition suitable for being envisaged in order to obtain the dielectric material constituting the middle portion 7 and the end portions 9 and 11 of the nozzle 5.

Figure 2:
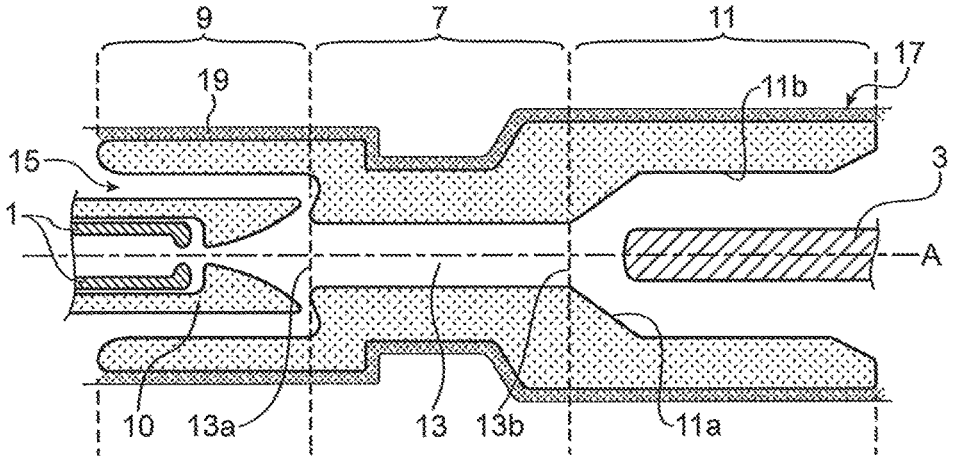
FIG. 2 is a fragmentary and diagrammatic view in longitudinal section of a circuit breaker including an electric arc-blast nozzle of the invention, the nozzle being provided with a sheath.

FIG. 2 shows a nozzle 17 of the invention, which is of the type shown in FIG. 1 and which further comprises a sheath 19 disposed on the outside surface of each of the two end portions 9 and 11 and on the outside surface of the throat-forming middle portion 7.

The sheet 19 is formed from a second dielectric material that also presents good mechanical properties and good high-temperature behavior. Typically, this second dielectric material is obtained from a second composition having a polymer matrix, such as a PTFE matrix, and may include one or more inorganic fillers.

Reference may be made to the summary of the invention for further details about the different variants of this second composition suitable for being envisaged in order to obtain the second dielectric material constituting the sheet 19.

The invention claimed is:

1. An electric arc-blast nozzle for a circuit breaker comprising:

a middle portion forming a throat defining internally an axial passage for breaking an electric arc, and two end portions extending on either side of the middle portion and being designed to receive respective arcing contacts and that are movable axially relative to each other, between an open position of the circuit breaker in which the arcing contacts and are separated from each other and a closed position of the circuit breaker in which the arcing contacts and are in contact with each other and in which one of the arcing contacts partially closes the axial passage of the middle portion, an arc-control gas flowing through the axial passage of the middle portion in order to interrupt an electric arc that is likely to form during movement of the arcing contacts and from the closed position to the open position of the circuit breaker, the electric arc-blast nozzle being characterized in that the middle portion together with the two end portions are made of a same dielectric material obtained from a composition consisting of a fluorocarbon polymer matrix and of at least one oxide, the oxide(s) being present in a proportion by weight lying in the range 11% to 50%, relative to the total weight of the composition.

2. An electric arc-blast nozzle according to claim 1, wherein the proportion by weight of the at least one oxide lies in the range 12% to 25% relative to the total weight of the composition.

3. An electric arc-blast nozzle according to claim 1, wherein the at least one oxide is a metal oxide, this metal oxide being selected from $TiO_2$, $Al_2O_3$, $Al_2CoO_4$, $Nb_2O_3$ and $BaTiO_3$ and, in an embodiment, from $Al_2O_3$ and $Al_2CoO_4$.

4. An electric arc-blast nozzle according to claim 1, wherein the at least one oxide is a non-metal oxide, this non-metal oxide being selected from $SiO_2$, $P_2O_5$ and $Bi_2O_3$ and, in an embodiment, $SiO_2$.

5. An electric arc-blast nozzle according to claim 1, wherein the at least one oxide consists in an alloy of at least one metal oxide and/or of at least one non-metal oxide.

6. An electric arc-blast nozzle according to claim 5, wherein the alloy is $Bi_2O_3$—ZnO—$Nb_2O_3$.

7. An electric arc-blast nozzle according to claim 1, wherein the fluorocarbon polymer of the composition is selected from a polytetrafluoroethylene, a vinylidene polyfluoride and a copolymer of ethylene and of tetrafluoroethylene, and is, in an embodiment, a polytetrafluoroethylene.

8. An electric arc-blast nozzle according to claim 1, further comprising a sheath disposed on the outside surface of each of the two end portions and on the outside surface of the middle portion forming a throat.

9. An electric arc-blast nozzle according to claim 1, wherein both of the arcing contacts and are movable.

10. An electric arc-blast nozzle according to claim 1, wherein it further comprises a cap that surrounds the arcing contact, this cap being in an embodiment made of the same dielectric material than the dielectric material of the middle portion and the two end portions.

11. A medium- or high-voltage circuit breaker comprising:

at least two arcing contacts and that are movable axially relative to each other, between an open position of the circuit breaker in which the arcing contacts and are separated from each other and a closed position of the circuit breaker in which the arcing contacts and are in contact with each other, an electric arc-blast nozzle as defined according to any one of claims 1 to 10, and an arc-control gas flowing through the axial passage of the middle portion of the nozzle in order to interrupt an electric arc that is likely to form during movement of the arcing contacts and from the closed position to the open position of the circuit breaker.

12. A circuit breaker according to claim 11, wherein the arc-control gas is constituted by carbon dioxide $CO_2$ or by a gas mixture comprising mostly $CO_2$.

* * * * *